US010746192B2

(12) United States Patent
Murata

(10) Patent No.: US 10,746,192 B2
(45) Date of Patent: Aug. 18, 2020

(54) ROTARY MACHINE AND IMPELLER

(71) Applicant: MITSUBISHI HEAVY INDUSTRIES COMPRESSOR CORPORATION, Tokyo (JP)

(72) Inventor: Masahiko Murata, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 108 days.

(21) Appl. No.: 16/122,017

(22) Filed: Sep. 5, 2018

(65) Prior Publication Data

US 2019/0078578 A1 Mar. 14, 2019

(51) Int. Cl.

| | |
|---|---|
| ***F04D 29/26*** | (2006.01) |
| ***F04D 29/28*** | (2006.01) |
| ***F04D 29/044*** | (2006.01) |
| ***F04D 29/42*** | (2006.01) |
| ***F04D 29/10*** | (2006.01) |
| ***F01D 5/02*** | (2006.01) |
| ***F01D 11/02*** | (2006.01) |

(Continued)

(52) U.S. Cl.

CPC ..... *F04D 29/266* (2013.01); *F01D 5/025* (2013.01); *F01D 5/026* (2013.01); *F01D 11/02* (2013.01); *F01D 11/04* (2013.01); *F04D 29/044* (2013.01); *F04D 29/102* (2013.01); *F04D 29/284* (2013.01); *F04D 29/4226* (2013.01); *F04D 17/10* (2013.01); *F05B 2240/57* (2013.01); *F05B 2240/60* (2013.01); *F05B 2260/301* (2013.01); *F05D 2230/53* (2013.01); *F05D 2240/60* (2013.01); *F05D 2260/31* (2013.01)

(58) Field of Classification Search

CPC ..... F01D 5/145; F01D 5/143; F01D 5/148; F01D 9/041; F04D 29/542; F04D 29/321; F04D 29/681; F04D 29/544; F05D 2250/71; F05D 2250/712; F05D 2250/711; F05D 2240/30; F05D 2240/123; F05D 2240/124

See application file for complete search history.

(56) References Cited

U.S. PATENT DOCUMENTS 4,311,004 A * 1/1982 du Pont ..... F04D 29/104 415/175
2010/0212493 A1* 8/2010 Rasmussen ..... B01D 53/04 95/45

FOREIGN PATENT DOCUMENTS

DE 3532929 A1 * 3/1987 ..... F01D 5/027
DE 3532929 A1 3/1987

(Continued)

*Primary Examiner* — Nathaniel E Wiehe
*Assistant Examiner* — Eric A Lange
(74) *Attorney, Agent, or Firm* — Osha Liang LLP

(57) ABSTRACT

A rotary machine includes a first impeller which rotates about an axis integrally with a rotating shaft, and a casing which covers the rotating shaft and the first impeller. The first impeller includes a circular-disk-shaped first disk part centered on the axis, a plurality of blade parts which extend from a surface facing a first side of the first disk part in an axial direction toward the first side in the axial direction and disposed at intervals in a circumferential direction, and an extension shaft which extends from a surface facing a second side of the first disk part in the axial direction toward the second side in the axial direction centered on the axis. An end portion of the extension shaft on the second side in the axial direction is connectable to an end portion of the rotating shaft on the first side in the axial direction.

3 Claims, 4 Drawing Sheets

(51) Int. Cl.
*F01D 11/04* (2006.01)
*F04D 17/10* (2006.01)

(56) References Cited

FOREIGN PATENT DOCUMENTS

| | | | | | |
|---|---|---|---|---|---|
| GB | 229805 | A | * | 3/1925 | ..... F16L 27/05 |
| JP | S58-196323 | A | | 11/1983 | |
| JP | H03-279698 | A | | 12/1991 | |
| JP | H04-008919 | A | | 1/1992 | |
| WO | 2013/110922 | A1 | | 8/2013 | |

* cited by examiner

ROTARY MACHINE AND IMPELLER

CROSS-REFERENCE TO RELATED APPLICATION

Priority is claimed on Japanese Patent Application No. 2017-173905, filed Sep. 11, 2017, the content of which is incorporated herein by reference.

BACKGROUND

Field

The present disclosure relates to a rotary machine and an impeller.

Description of Related Art

For example, rotary machines such as centrifugal compressors include impellers attached to rotating shafts and casings which cover the impellers from the outside and define flow paths together with the impellers. Centrifugal compressors compress fluids supplied from the outside via flow paths formed in casings using the rotation of impellers.

General impellers are fixed to rotating shafts through bolting. To be specific, through holes through which rotating shafts can be inserted are formed in centers of impellers. Nuts are fastened to threaded portions formed at shaft ends of the rotating shafts in a state in which the rotating shafts are inserted into the through holes. Thus, the impellers are fastened from the axial direction and fixed to the rotating shafts. As a specific example of impellers having such a constitution, the impeller described in Patent Literature 1 is known. The impeller described in Patent Literature 1 is fixed using a nut so that a back surface of the impeller is pushed against a spacer which extends to an outer circumferential side of a rotating shaft.

Patent Document

[Patent Document 1] Japanese Unexamined Patent Application, First Publication No. H3-279698

SUMMARY

Incidentally, apparatuses called expanders are known as a kind of rotary machine other than centrifugal compressors. Expanders are rotary machines which convert the thermal energy of working fluids into a rotating force when impellers and rotating shafts are rotated using high temperature and high pressure working fluids. In apparatuses such as such rotary machines in which high temperature and high pressure working fluids flow therein, thermal expansion occurs in the impellers and rotating shafts in some cases.

However, when thermal expansion occurs in a fixing structure using a nut as in Patent Literature 1, deviation occurs in a relative position between the nut and an impeller. Thus, the stable fixing between the impeller and a rotating shaft is not likely to be maintained in some cases.

The present disclosure provides a rotary machine and an impeller capable of maintaining stable fixing between an impeller and a rotating shaft.

A rotary machine according to a first aspect of the present disclosure includes: a rotating shaft which is rotatable about an axis; an impeller which is configured to rotate about the axis integrally with the rotating shaft; and a casing which covers the rotating shaft and the impeller, wherein the impeller includes: a circular-disk-shaped disk part centered on the axis; a plurality of blade parts which extend from a surface facing a first side of the disk part in an axial direction toward the first side in the axial direction and are disposed at intervals in a circumferential direction; and an extension shaft which is integrally formed with the disk part and extends from a surface facing a second side of the disk part in the axial direction toward the second side in the axial direction centered on the axis; wherein the rotary machine further includes a fixing part which is configured to fix an end portion of the extension shaft on the second side in the axial direction and an end portion of the rotating shaft on the first side in the axial direction.

With such a constitution, the impeller and the rotating shaft are connected at a position which is spaced apart from the disk part via the extension shaft. Even when the impeller is exposed to a high temperature working fluid, the extension shaft which is not directly exposed to the working fluid is hardly affected by thermal expansion. As a result, it is possible to minimize an amount of deviation of a connection portion between the impeller and the rotating shaft due to thermal expansion.

In the rotary machine according to a second aspect of the present disclosure, in the first aspect, the extension shaft may include an extension shaft main body which has a columnar shape centered on the axis and a first flange part which is provided at the end portion of the extension shaft main body on the second side in the axial direction and extends from an outer circumferential surface of the extension shaft main body to the outside in the radial direction centered on the axis. The rotating shaft may include a rotating shaft main body which has a columnar shape centered on the axis and a second flange part which is provided at the end portion of the rotating shaft main body on the first side in the axial direction and extends to the outside in the radial direction. The fixing part may fix the first flange part and the second flange part.

With such a constitution, the extension shaft and the rotating shaft are connected using the first flange part and the second flange part. Moreover, the first flange part and the second flange part are fixed to each other using the fixing part at the outer circumferential side relative to the rotating shaft main body and the extension shaft main body. Here, in heat transmitted from the disk part exposed to the working fluid to the extension shaft and the rotating shaft, an amount of heat transmitted decreases from the center of the extension shaft main body toward the outer circumferential side. For this reason, an amount of thermal expansion due to heat received by the disk part is reduced in the first flange part and the second flange part. Therefore, when the impeller and the rotating shaft are fixed using the first flange part and the second flange part, a constitution which is less susceptible to thermal expansion is possible. Thus, it is possible to more reliably maintain stable fixation between the impeller and the rotating shaft.

In the rotary machine according to a third aspect of the present disclosure, in the second aspect, a plurality of first concave parts which are recessed toward the second side in the axial direction and disposed at intervals in the circumferential direction and a first through hole which passes through a surface facing the first side of each of the first concave parts in the axial direction may be formed in the first flange part. A plurality of second concave parts which are recessed toward the first side in the axial direction and disposed at positions corresponding to the first concave parts in the circumferential direction and a second through hole which passes through a surface facing the second side of each of the second concave parts in the axial direction may be formed in the second flange part. The fixing part may include a bolt inserted into the first through hole and the second through hole, and a nut attached to the bolt. A head portion of the bolt and the nut may be respectively accommodated in either of the first concave part or the second concave part.

With such a constitution, the head portion of the bolt and the nut are respectively accommodated in any one of the first concave part and the second concave part. That is to say, the head portion of the bolt and the nut do not protrude from the outer surfaces of the first flange part and the second flange part. Thus, it is possible to reduce the windage loss received by the head portion of the bolt and the nut when the extension shaft and the rotating shaft rotate about the axis. Therefore, it is possible to minimize the windage loss due to the fixing part which fixes the impeller to the rotating shaft and to improve the efficiency of the rotor.

In the rotary machine according to a fourth aspect of the present disclosure, in the second or third aspect, the rotary machine may include a cooling part which is configured to cool an outer circumferential surface of the extension shaft, wherein the cooling part may be disposed between the first flange part and the disk part in the axial direction.

With such a constitution, it is possible to minimize an amount of heat transmitted to the first flange part by cooling the extension shaft main body between the disk part and the first flange part. Therefore, it is possible to further minimize the influence due to the thermal expansion at the first flange part.

In the rotary machine according to a fifth aspect of the present disclosure, in the fourth aspect, the cooling part may include a seal part which seals between the extension shaft and the casing using a seal gas and cools the extension shaft using the seal gas.

With such a constitution, it is possible to seal a space between the extension shaft and the casing using a seal gas and at the same time to cool the extension shaft using a seal gas. Thus, it is possible to cool the extension shaft without separately preparing a coolant for cooling the extension shaft.

In the rotary machine according to a sixth aspect of the present disclosure, in the fifth aspect, the seal part may be a labyrinth seal.

With such a constitution, it is possible to reduce the leakage of a working fluid in a space between the extension shaft and the casing.

An impeller according to a seventh aspect of the present disclosure includes: a circular-disk-shaped disk part centered on an axis; a plurality of blade parts which extend from a surface facing a first side of the disk part in an axial direction toward the first side in the axial direction and disposed at intervals in a circumferential direction; and an extension shaft which extends from a surface facing a second side of the disk part in the axial direction toward the second side in the axial direction centered on the axis, wherein an end of the extension shaft on the second side in the axial direction is connectable to an end portion of a rotating shaft in a rotary machine on the first side in the axial direction.

In the impeller according to an eighth aspect of the present disclosure, in the seventh aspect, the extension shaft may include an extension shaft main body which has a columnar shape centered on the axis and a first flange part which is provided at the end portion of the extension shaft main body on the second side in the axial direction and extends from an outer circumferential surface of the extension shaft main body to the outside in a radial direction centered on the axis. The first flange part may have a fixing part which is connectable to the rotating shaft.

According to the present disclosure, it is possible to maintain stable fixing of an impeller and a rotating shaft under a high temperature.

DETAILED DESCRIPTION

Figure 1:
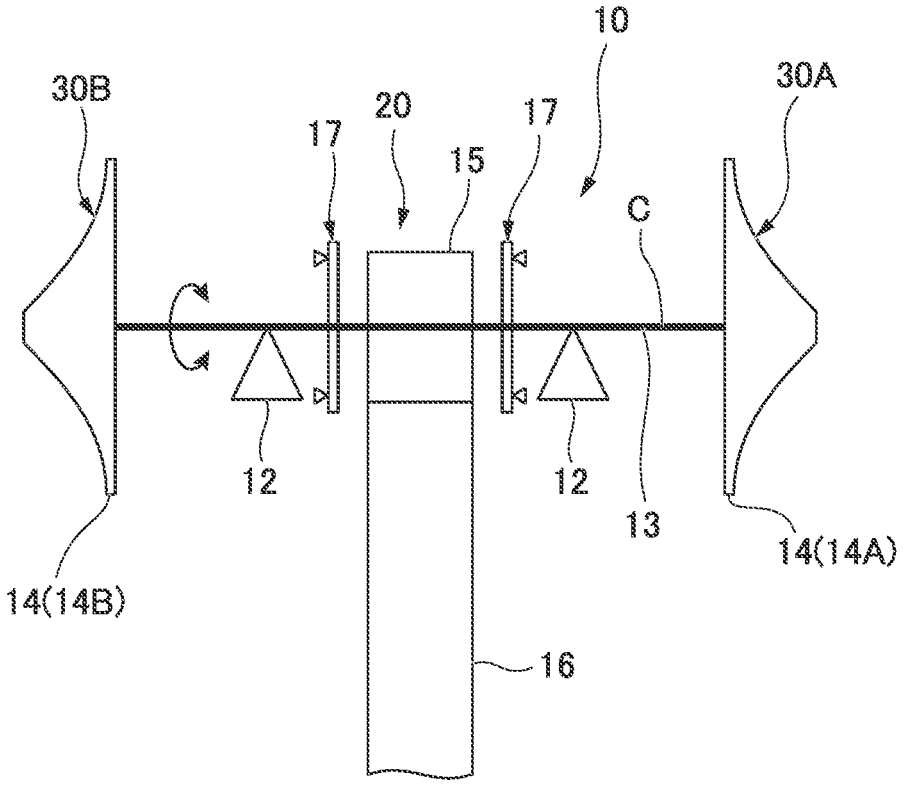
FIG. 1 is a schematic diagram showing a constitution of a rotary machine according to an embodiment of the present disclosure.
Figure 2:
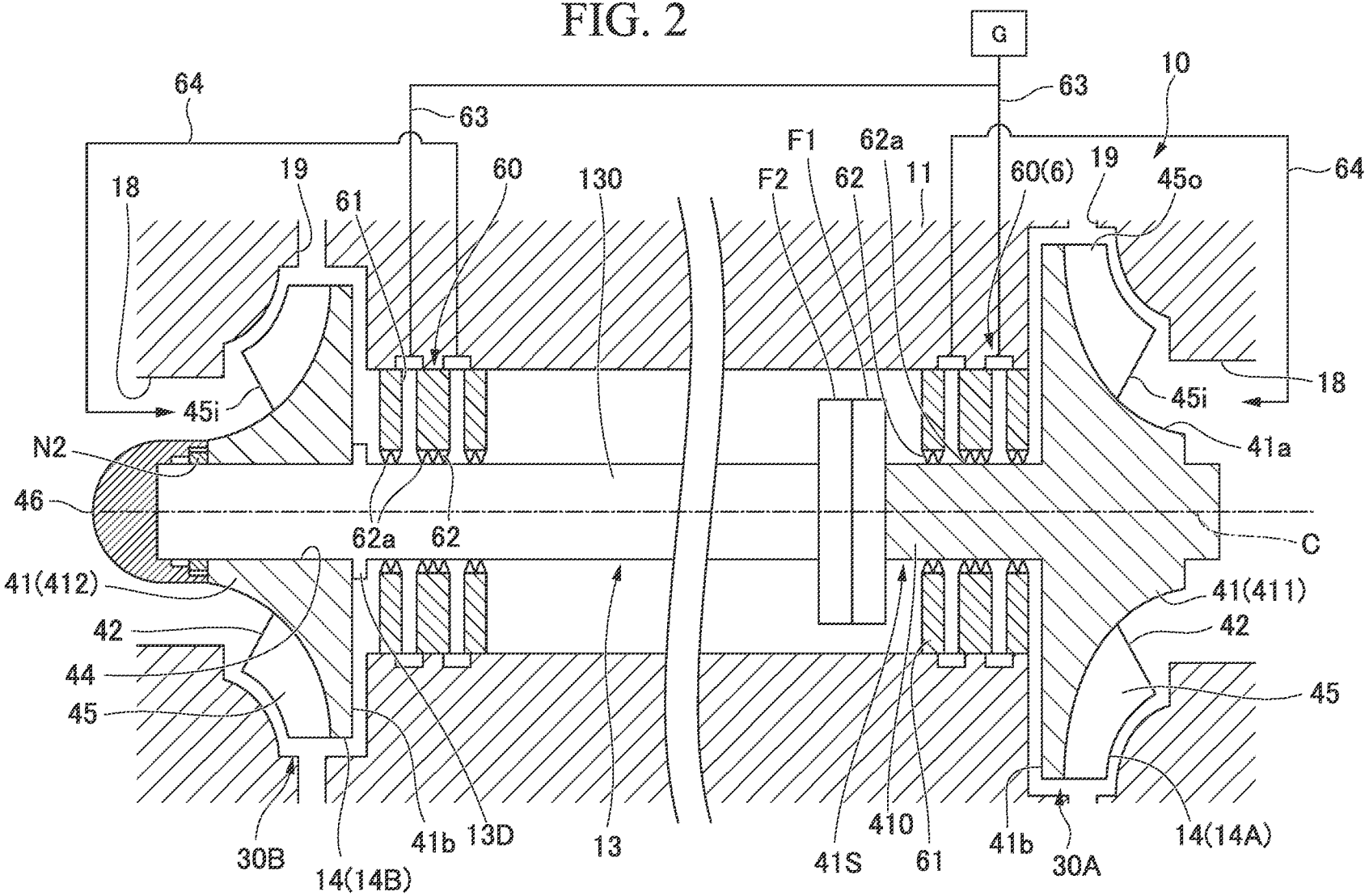
FIG. 2 is a cross-sectional view of a main part showing an internal constitution of the rotary machine according to the embodiment of the present disclosure.
Figure 3:
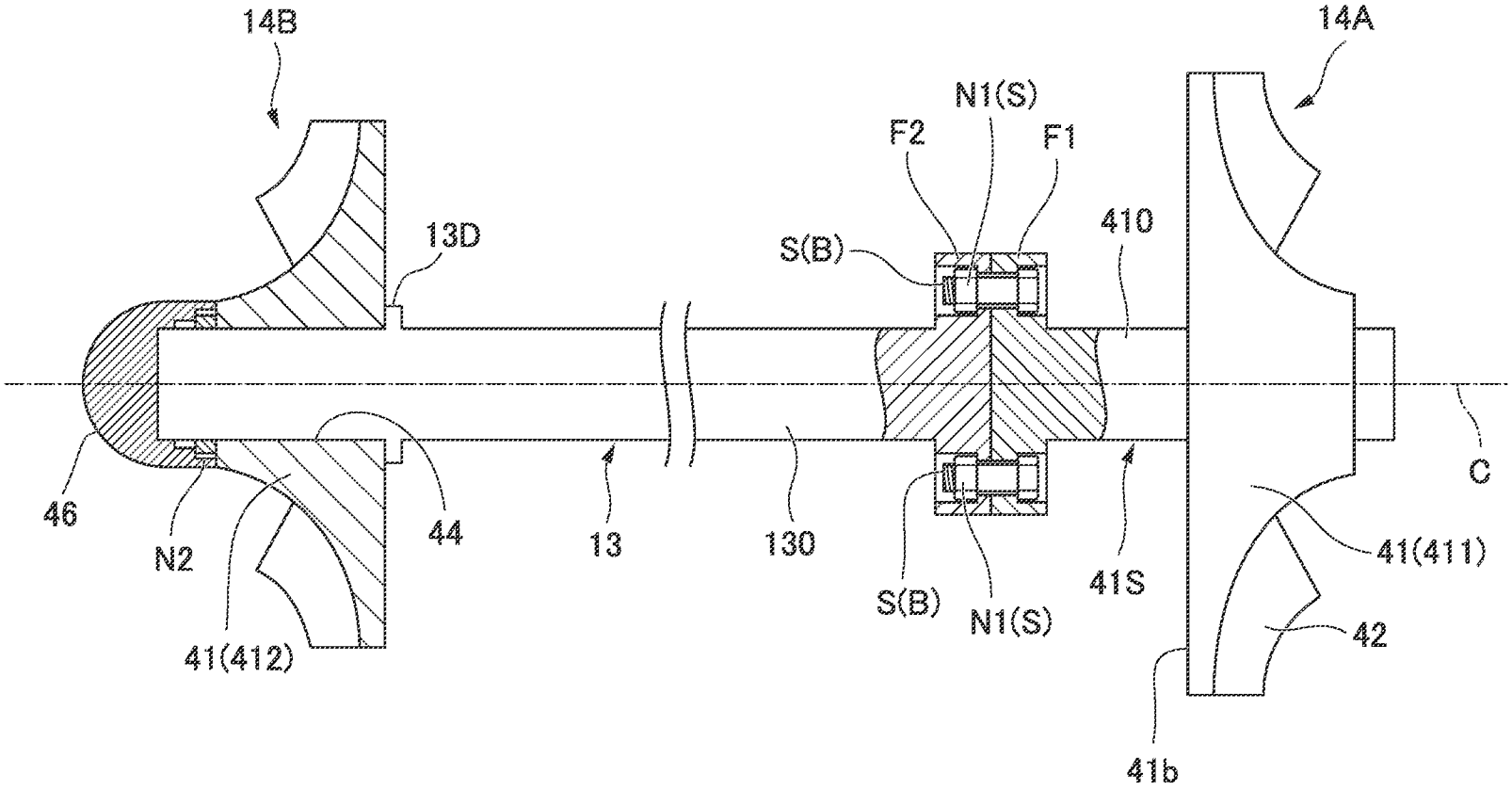
FIG. 3 is a diagram showing a constitution of a rotating shaft and an impeller according to the embodiment of the present disclosure.

As illustrated in FIGS. 1 to 3, a rotary machine 10 according to this embodiment includes a casing 11 (refer to FIG. 2), radial bearings 12, a rotating shaft 13, respective impellers 14 (a first impeller 14A or a second impeller 14B), a pinion gear 15, a driving gear 16, a thrust bearing 17, fixing parts S (refer to FIG. 3), and a cooling part 6 (refer to FIG. 2). The rotary machine 10 according to this embodiment is a geared centrifugal compressor.

As illustrated in FIG. 2, the casing 11 forms an outer shell for the rotary machine 10. The casing 11 covers the radial bearings 12, the rotating shaft 13, and the impeller 14 from an outer circumferential side thereof.

As illustrated in FIG. 1, the pair of radial bearings 12 are provided in the casing 11 at intervals in an axis C direction in which an axis C of the rotating shaft 13 extends. The radial bearings 12 are held in the casing 11.

The rotating shaft 13 has a columnar shape centered on the axis C. The rotating shaft 13 is rotatable about the axis C. The rotating shaft 13 is supported by the pair of radial bearings 12 and the thrust bearing 17.

The pinion gear 15 is provided between the pair of radial bearings 12 in the rotating shaft 13. That is to say, the pinion gear 15 is disposed further inward in the axis C direction than the pair of radial bearings 12. The pinion gear 15 meshes with the driving gear 16. The driving gear 16 is rotatably driven using an external driving source. The driving gear 16 has an outer diameter dimension larger than that of the pinion gear 15. Therefore, the rotational speed of the rotating shaft 13 which includes the pinion gear 15 is higher than the rotational speed of the driving gear 16.

A speed increasing transmission part 20 is configured such that the rotational speed of the driving gear 16 using the external driving source is increased via the pinion gear 15 using the pinion gear 15 and the driving gear 16 and the increased speed is transmitted to the rotating shaft 13.

The thrust bearing 17 is provided on the rotating shaft 13 at a position spaced apart from the pinion gear 15 in the axis C direction. The thrust bearing 17 is disposed further inward in the axis C direction than the pair of radial bearings 12. The thrust bearing 17 restricts the movement of the rotating shaft 13 in the axis C direction.

The impeller 14 is fixed to the rotating shaft 13 at a position spaced apart from the radial bearings 12 in the axis C direction. The impeller 14 rotates integrally with the rotating shaft 13 about the axis C. The impeller 14 in this embodiment is fixed to an end portion of the rotating shaft 13 further outward in the axis C direction than the pair of radial bearings 12. As illustrated in FIG. 2, each impeller 14 (the first impeller 14A or the second impeller 14B) is a so-called open impeller including a disk part 41 and blade parts 42 in this embodiment. The first impeller 14A and the second impeller 14B have the same constitution except for fixing structures with respect to the rotating shaft 13 which will be described later and a constitution of the disk part 41. Thus, description will be provided below using the first impeller 14A as a representative example.

The disk part 41 (first disk part 411) in the first impeller 14A has a circular disk shape centered on the axis C. The first disk part 411 is formed as a concave curved surface whose outer diameter gradually increases from a first surface 41*a* side of one side of the first disk part 411 in the axis C direction (a first side in the axis C direction) toward a second surface 41*b* side of the other side thereof (a second side in the axis C direction). The plurality of blade parts 42 are provided on the first disk part 411 at intervals in a circumferential direction centered on the axis C. The plurality of blade parts 42 extend from a first surface 41*a* serving as a surface facing one side of the disk part 41 in the axis C direction toward one side in the axis C direction.

An impeller flow path 45 is formed of the first disk part 411 and the blade parts 42. The impeller flow path 45 has an inflow port 45*i* which is open toward one side in the axis C direction and an outflow port 45*o* which is open outward in a radial direction centered on the axis C of the impeller 14.

Here, the casing 11 defines an air intake flow path 18 and an air exhaust flow path 19 in the periphery of the first impeller 14A. The air intake flow path 18 communicates with the inflow port 45*i* in the impeller flow path 45 formed inside the first impeller 14A in the radial direction. The air exhaust flow path 19 communicates with the outflow port 45*o* in the impeller flow path 45 formed on the side outwards from the first impeller 14A in the radial direction. The air exhaust flow path 19 is formed on the outer side in the radial direction of the outflow port 45*o* in the impeller flow path 45. The air exhaust flow path 19 has a continuous spiral shape around the axis C.

An expander part 30A and a compression part 30B are constituted of the first impeller 14A, the second impeller 14B, the air intake flow path 18, and the air exhaust flow path 19. To be specific, as illustrated in FIG. 1, the rotary machine 10 includes the expander part 30A having the first impeller 14A on one side thereof in the axis C direction when viewed from the speed increasing transmission part 20, and the compression part 30B having the second impeller 14B on the other side thereof in the axis C direction when viewed from the speed increasing transmission part 20.

A high temperature and high pressure working fluid is introduced from the outside into the expander part 30A and the rotating shaft 13 and the impeller 14 (the first impeller 14A) are rotatably driven. The impeller 14 (the second impeller 14B) in the compression part 30B coaxially connected through the rotating shaft 13 is also driven along with the driving of the expander part 30A.

The fixing structure of the first impeller 14A and the second impeller 14B according to this embodiment will be described below with reference to FIG. 3. The fixing structures of the first impeller 14A and the second impeller 14B with respect to the rotating shaft 13 are different from each other.

As illustrated in FIG. 3, the first impeller 14A includes an extension shaft 41S provided on a surface on the other side of the disk part 41 (the first disk part 411) in the axis C direction. The extension shaft 41S extends from the second surface 41*b* facing the other side of the disk part 41 in the axis C direction toward the other side of the disk part 41 in the axis C direction centered on the axis C. The extension shaft 41S is integrally formed with the first disk part 411. The other end portion of the extension shaft 41S in the axis C direction is connectable to one end portion of the rotating shaft 13 in the axis C direction. The extension shaft 41S is fixed to the rotating shaft 13 using the fixing parts S. The fixing parts S in this embodiment have bolts B and nuts N1.

The extension shaft 41S in this embodiment includes an extension shaft main body 410 and a first flange part F1. It should be noted that it is desirable that an extension shaft main body 410 and the first flange part F1 be integrally molded by carving an aluminum alloy or the like in the first impeller 14A.

The extension shaft main body 410 has a circular columnar shape centered on the axis C. The extension shaft main body 410 extends from a central position of the first disk part 411 in the radial direction (that is, an axis C position) toward the other side thereof in the axis C direction. The extension shaft main body 410 is integrally formed with the first disk part 411. The extension shaft main body 410 may be integrally formed with the first disk part 411 through carving and may be integrally formed with the first disk part 411 through welding. That is to say, the extension shaft main body 410 need not be fixed to the first disk part 411 using a separate member such as a bolt. An outer circumferential surface of the extension shaft main body 410 is in sliding contact with a labyrinth part 62 in a seal part 60 which will be described later.

The first flange part F1 is provided on the other end portion of the extension shaft main body 410 in the axis C direction. The first flange part F1 extends from an outer circumferential surface of an end portion of the extension shaft main body 410 outward in the radial direction of the axis C. The other end surface of the first flange part F1 in the axis C direction forms a planar shape perpendicular to the axis C together with the other end surface of the extension shaft main body 410 in the axis C direction.

Figure 4:
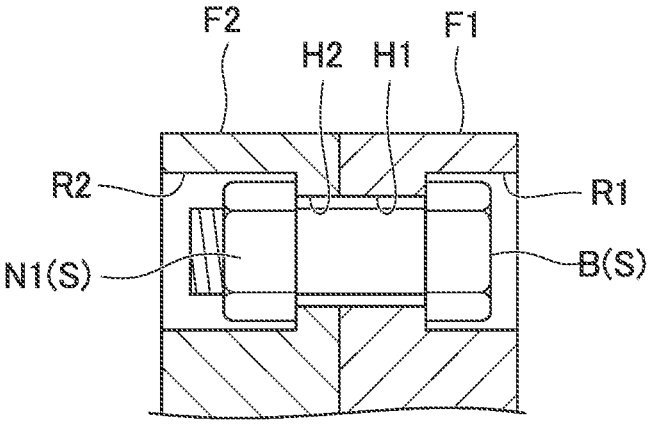
FIG. 4 is an enlarged diagram of a main part showing a constitution of a fixing part according to the embodiment of the present disclosure.

As illustrated in FIG. 4, the first flange part F1 has a first concave part R1 and a first through hole H1 formed therein. A plurality of first concave parts R1 and first through holes H1 may be formed at equal intervals in the circumferential direction of the axis C.

The first concave part R1 is recessed from an outer surface thereof facing one side of the first flange part F1 in the axis C direction to the other side thereof in the axis C direction. The first concave part R1 in this embodiment has a circular shape. The first concave part R1 is formed at a position deviated closer to the outer circumferential side than a connection position between the first flange part F1 and the extension shaft main body 410. The first concave part R1 is configured to be able to accommodate a head portion of a bolt B serving as a fixing part S.

The first through hole H1 is a hole coaxial with the first concave part R1. The first through hole H1 passes through a bottom surface of the first concave part R1 and a surface facing the other side of the first flange part F1 in the axis C direction. The first through hole H1 is formed to have a size in which a threaded portion of a bolt B serving as a fixing part S can be inserted therein but the head portion cannot be inserted therein. A diameter dimension of the first through hole H1 is smaller than a diameter dimension of the first concave part R1.

A second flange part F2 in the rotating shaft 13 is connected to the first flange part F1. As illustrated in FIGS. 2 and 3, the rotating shaft 13 in this embodiment includes a rotating shaft main body 130 and the second flange part F2. The rotating shaft main body 130 has a circular columnar shape centered on the axis C. The rotating shaft main body 130 has the same diameter as the extension shaft main body 410.

The second flange part F2 is provided on one end portion of the rotating shaft main body 130 in the axis C direction. The second flange part F2 extends from an outer circumferential surface of the rotating shaft main body 130 outward in the radial direction on the axis C. The second flange part F2 has the same diameter as the first flange part F1. One end surface of the second flange part F2 in the axis C direction forms a planar shape perpendicular to the axis C together with one end surface of the rotating shaft main body 130 in the axis C direction.

As illustrated in FIG. 4, the second flange part F2 has a second concave part R2 and a second through hole H2 formed therein. A plurality of second concave part R2 and second through hole H2 may be formed at equal intervals in the circumferential direction of the axis C. The second concave part R2 and the second through hole H2 in this embodiment are formed in the same number and at the same positions as the first concave parts R1 and the first through hole H1.

The second concave part R2 is recessed from an outer surface facing the other side of the second flange part F2 in the axis C direction to one side thereof in the axis C direction. The second concave part R2 is disposed at a position corresponding to the first concave part R1 in the circumferential direction. The second concave part R2 is formed at a position deviated closer to the outer circumferential side than a connection position between the second flange part F2 and the rotating shaft main body 130. The second concave part R2 is configured to be able to accommodate a nut N1 serving as a fixing part S.

The second through hole H2 is a hole coaxial with the second concave part R2. The second through hole H2 passes through a bottom surface of the second concave part R2 and a surface facing one side of the second flange part F2 in the axis C direction. The second through hole H2 is formed to have a size in which a threaded portion of a bolt B as a fixing part S can be inserted therein but a nut N1 cannot be inserted therein. A diameter dimension of the second through hole H2 is smaller than a diameter dimension of the second concave part R2. The diameter dimension of the second through hole H2 is the same as the diameter dimension of the first through hole H1.

The other end surface of the first flange part F1 in the axis C direction and one end surface of the second flange part F2 in the axis C direction are in contact with each other from both sides in the axis C direction. In this state, the threaded portion of the bolt B is inserted into the first through hole H1 and the second through hole H2. At that time, the head portion of the bolt B is accommodated in the first concave part R1 and does not protrude from an outer surface of the first flange part F1. The nut N1 is attached to a shaft end of the bolt B. The nut N1 is accommodated in the second concave part R2 and does not protrude from the outer surface of the second flange part F2.

As described above, the first flange part F1 in the first impeller 14A is connected to the second flange part F2 in the rotating shaft 13 using the bolt B and the nut N1 as the fixing part S. It should be noted that it is desirable that a reamer bolt be used as the bolt B serving as the fixing part S. Furthermore, although the fixing part S is provided such that the head portion of the bolt B is disposed in the first concave part R1 in this embodiment, a constitution in which the bolt B is inserted from the second flange part F2 side and the nut N1 is provided on the first flange part F1 side such that the head portion of the bolt B is disposed in the second concave part R2 may be adopted. That is to say, the bolt B and the nut N1 may be provided at positions opposite to those described above. Therefore, the head portion of the bolt B and the nut N1 may be accommodated in either the first concave part R1 or the second concave part R2.

On the other hand, as illustrated in FIGS. 2 and 3, unlike the first impeller 14A, the second impeller 14B has a mounting hole 44 formed to pass through the disk part 41 (second disk part 412) therein. The rotating shaft main body 130 is inserted into the mounting hole 44. The second impeller 14B is fixed to an end portion of the rotating shaft main body 130 via the mounting hole 44 using a nut N2. A large diameter part 13D having a diameter dimension larger than those of the other portions is provided on the rotating shaft main body 130. When fastening is performed using the nut N2 from the other side in the axis C direction, a back surface of the second disk part 412 (a surface facing one side in the axis C direction) is pushed against the large diameter part 13D from the other side in the axis C direction. An outer circumferential side of the nut N2 and an end portion of the rotating shaft main body 130 are covered with a spinner 46 which has a pointed head shape toward the other side in the axis C direction.

Also, as illustrated in FIG. 2, in a centrifugal compressor 1, the cooling part 6 is provided between the expander part 30A and the compression part 30B, and the speed increasing transmission part 20 (refer to FIG. 1) in the casing 11. The cooling part 6 is configured to be able to cool an outer circumferential surface of the extension shaft 41S. The cooling part 6 is disposed between the disk part 41 in the first impeller 14A and the first flange part F1 in the axis C direction. The cooling part 6 in this embodiment cools the outer circumferential surface of the extension shaft main body 410. The cooling part 6 includes the seal part 60.

The seal part 60 seals between the rotating shaft 13 and the casing 11 using a seal gas. When the seal part 60 supplies the seal gas to the outer circumferential surface of the extension shaft main body 410, the extension shaft 41S is cooled using the seal gas. The seal part 60 in this embodiment is a labyrinth seal. The seal part 60 integrally includes a ring main body 61 fixed to the casing 11 and the labyrinth part 62 including a sliding contact surface 62*a* provided inside the ring main body 61 in the radial direction and being in sliding contact with the outer circumferential surface of the extension shaft main body 410.

One end of a seal gas supply path 63 and one end of a seal gas discharge path 64 are connected to the seal part 60. The other end of the seal gas supply path 63 is connected to an external gas supply source G. The other end of the seal gas discharge path 64 is connected to the air intake flow path 18. When a seal gas supplied from the gas supply source G flows into the labyrinth part 62, the leakage of a working fluid flowing through this space is sealed. A seal gas discharged from the labyrinth part 62 enters the air intake flow path 18 through the seal gas discharge path 64.

In the above-described constitution, the first impeller 14A and the rotating shaft 13 are connected at a position away from the disk part 41 via the extension shaft 41S. Even when the first impeller 14A is exposed to a high temperature working fluid, the extension shaft 41S which is not directly exposed to the working fluid is hardly affected by thermal expansion. As a result, it is possible to minimize an amount of deviation of a connection portion between the first impeller 14A and the rotating shaft 13 due to thermal expansion. Therefore, it is possible to stably maintain fixation between the first impeller 14A and the rotating shaft 13 under a high temperature. Thus, it is possible to stably transmit a torque even under a high temperature.

In addition, according to the above-described constitution, the extension shaft 41S and the rotating shaft 13 are connected using the first flange part F1 and the second flange part F2. Moreover, the first flange part F1 and the second flange part F2 are fixed to each other using the fixing part S at the outer circumferential side relative to the rotating shaft main body 130 and the extension shaft main body 410. Here, in heat transmitted from the disk part 41 exposed to the working fluid to the extension shaft 41S and the rotating shaft 13, an amount of heat to be transmitted decreases from the center of the extension shaft main body 410 toward the outer circumferential side. For this reason, an amount of thermal expansion due to heat received by the first disk part 411 is reduced in the first flange part F1 and the second flange part F2. Therefore, when the first impeller 14A and the rotating shaft 13 are fixed using the first flange part F1 and the second flange part F2, a constitution which is less susceptible to thermal expansion is possible. Thus, it is possible to more reliably maintain stable fixation between the first impeller 14A and the rotating shaft 13.

In addition, according to the above-described constitution, the head portion of the bolt B and the nut N1 in the fixing part S are accommodated in either the first concave part R1 or the second concave part R2. That is to say, the head portion of the bolt B and the nut N1 do not protrude from the outer surfaces of the first flange part F1 and the second flange part F2. Furthermore, in other words, it is possible to eliminate projections from the outer surfaces of the first flange part F1 and the second flange part F2 and keep the outer surface smooth. Thus, it is possible to reduce the windage loss received by the head portion of the bolt B and the nut N1 when the extension shaft 41S and the rotating shaft 13 rotate about the axis C. Therefore, it is possible to minimize the windage loss due to the fixing part S which fixes the first impeller 14A to the rotating shaft 13 and to improve the efficiency of the rotary machine 10.

Also, the cooling part 6 cools the extension shaft main body 410 between the first flange part F1 and the disk part 41. For this reason, it is possible to minimize an amount of heat transmitted from the disk part 41 to the first flange part F1. Therefore, it is possible to further minimize the influence of thermal expansion in the first flange part F1.

In addition, according to the above-described constitution, the cooling part 6 includes the seal part 60. For this reason, it is possible to seal a space between the extension shaft main body 410 and the casing 11 using the seal part 60 and at the same time to cool the extension shaft main body 410 using a seal gas. Thus, it is possible to cool the extension shaft main body 410 without separately preparing a coolant for cooling the extension shaft main body 410. Particularly, it is possible to reduce the leakage of the working fluid in the space between the rotating extension shaft 41S and the casing 11 because the seal part 60 is the labyrinth seal.

The embodiment according to the present disclosure has been described above with reference to the drawings. Note that the above-described constitution is an example and it is possible to apply various changes or modifications to this constitution. For example, in the above-described embodiment, the present disclosure is applied to only one impeller 14 (the first impeller 14A) of the pair of impellers 14. However, it is also possible to apply the present disclosure the second impeller 14B in addition to the first impeller 14A. Particularly, the present disclosure can be appropriately applied to an impeller in a rotary machine into which a high temperature working fluid is introduced.

Also, the present disclosure is applied to an open impeller in the above-described embodiment. However, the present disclosure can be applied to the first impeller 14A even when the first impeller 14A is a closed impeller having a cover part.

An example in which the labyrinth seal is used as the seal part 60 has been described in the above-described embodiment. However, an aspect of the seal part 60 is not limited to the above-described aspect and it is also possible to apply a seal fin as the seal part 60.

EXPLANATION OF REFERENCES

10 Rotary machine
11 Casing
12 Radial bearing
13 Rotating shaft
13D Large diameter part
14 Impeller
14A First impeller
14B Second impeller
15 Pinion gear
16 Driving gear
17 Thrust bearing
18 Air intake flow path
19 Air exhaust flow path
20 Speed increasing transmission part
30A Expander part
30B Compression part
41 Disk part
41*a* First surface
41*b* Second surface
41S Extension shaft
411 First disk part
412 Second disk part
42 Blade part
44 Mounting hole
45 Impeller flow path
45*i* Inflow port
45*o* Outflow port
46 Spinner
60 Seal part
61 Ring main body
62 Labyrinth part
62*a* Sliding contact surface
63 Seal gas supply path
64 Seal gas discharge path
B Bolt
F1 First flange part
F2 Second flange part
H1 First through hole
H2 Second through hole
N1, N2 Nut
R1 First concave part
R2 Second concave part
S Fixing part

What is claimed is:

1. A rotary machine, comprising:

a rotating shaft which is rotatable about an axis;

an impeller which is configured to rotate about the axis integrally with the rotating shaft; and a casing which covers the rotating shaft and the impeller, wherein the impeller includes:

a circular-disk-shaped disk part centered on the axis;

a plurality of blade parts which extend from a surface facing a first side of the disk part in an axial direction toward the first side in the axial direction and are disposed at intervals in a circumferential direction; and an extension shaft which is integrally formed with the disk part and extends from a surface facing a second side of the disk part in the axial direction toward the second side in the axial direction centered on the axis;

wherein the rotary machine further comprises a fixing part which is configured to fix an end portion of the extension shaft on the second side in the axial direction and an end portion of the rotating shaft on the first side in the axial direction, wherein the extension shaft includes:

an extension shaft main body which has a columnar shape centered on the axis; and a first flange part which is provided at the end portion of the extension shaft main body on the second side in the axial direction and extends from an outer circumferential surface of the extension shaft main body to the outside in the radial direction centered on the axis, wherein the rotating shaft includes:

a rotating shaft main body which has a columnar shape centered on the axis; and a second flange part which is provided at the end portion of the rotating shaft main body on the first side in the axial direction and extends to the outside in the radial direction, wherein the fixing part fixes the first flange part and the second flange part, wherein a plurality of first concave parts which are recessed toward the second side in the axial direction and disposed at intervals in the circumferential direction, and a first through hole which passes through a surface facing the first side of each of the first concave parts in the axial direction are formed in the first flange part, wherein a plurality of second concave parts which are recessed toward the first side in the axial direction and disposed at positions corresponding to the first concave parts in the circumferential direction, and a second through hole which passes through a surface facing the second side of each of the second concave parts in the axial direction are formed in the second flange part, wherein the fixing part includes a bolt inserted into the first through hole and the second through hole, and a nut attached to the bolt, wherein a head portion of the bolt and the nut are respectively accommodated in either the first concave part or the second concave part, wherein the rotary machine further comprises a cooling part which is configured to cool an outer circumferential surface of the extension shaft, and wherein the cooling part is disposed between the first flange part and the disk part in the axial direction.

2. The rotary machine according to claim 1, wherein the cooling part includes a seal part which seals between the extension shaft and the casing using a seal gas and cools the extension shaft using the seal gas.

3. The rotary machine according to claim 2, wherein the seal part is a labyrinth seal.

* * * * *